United States Patent [19]

Penick

[11] Patent Number: 5,022,681

[45] Date of Patent: Jun. 11, 1991

[54] PAPER POP-UP DEVICES AND METHOD OF MAKING THE SAME

[75] Inventor: Ib Penick, Palatine, Ill.

[73] Assignee: Christopher Crowell, Old Lyme, Conn.

[21] Appl. No.: 410,358

[22] Filed: Sep. 21, 1989

[51] Int. Cl.[5] ..... A63H 33/38; B42D 1/00

[52] U.S. Cl. ..... 281/15.11; 40/124.1; 446/148

[58] Field of Search ..... 40/124.1, 530; 446/148; 428/212; 281/2, 5, 15.1

[56] References Cited

U.S. PATENT DOCUMENTS

| | | | |
|---|---|---|---|
| 3,035,363 | 5/1962 | Luchsinger | 446/148 |
| 3,995,388 | 12/1976 | Penick et al. | 40/126 A |
| 4,103,444 | 8/1978 | Jones et al. | 40/124.1 |
| 4,212,231 | 7/1980 | Penick et al. | 93/1 F |
| 4,313,270 | 2/1982 | Volkert et al. | 40/124.1 |
| 4,337,589 | 7/1982 | Volkert et al. | 40/124.1 |
| 4,349,973 | 9/1982 | Penick et al. | 40/124.1 |
| 4,592,573 | 6/1986 | Crowell | 283/56 |
| 4,774,780 | 10/1988 | Crowell | 446/148 |
| 4,874,356 | 10/1989 | Volkert | 40/124.1 |

*Primary Examiner*—Paul A. Bell
*Assistant Examiner*—Eugenia A. Jones
*Attorney, Agent, or Firm*—Mattern, Ware, Stoltz and Fressola

[57] ABSTRACT

In a pop-up device for use in a magazine or other publication or for use by itself such as a mailer or the like, two display elements are hingedly connected to a front of two covers. The opening of the front cover forces the erection of the two display elements and allows the elements to stand up out of the plane thereof. A spacing tab is connected between a foreground display element and the back cover and also is connected between a background display element and the back cover. The spacing tab restrains the displays from following the front panel a full one hundred eighty degrees while allowing them each to raise to a specified distance from the back cover. The pop-up is designed for mass-production mechanical fabrication and assembly. A blank is cut to form the display elements and the spacing tabs and is scored to form lines of weakness, which allow easy folding, in the appropriate places. Adhesive is then applied and, after appropriate plowing, folding and trimming processes, the pop-up device is formed.

22 Claims, 15 Drawing Sheets

PAPER POP-UP DEVICES AND METHOD OF MAKING THE SAME

BACKGROUND OF THE INVENTION

The present invention relates generally to printed paper novelty items of various types and more particularly to a specialty paper product wherein a "pop-up" is provided that, upon opening of the product, moves upward and out of the plane of the cover panels and is seen against one of the panels.

Advertising leaflets, inserts, mailers, novelty items, and the like have for many years utilized pop-up devices which, upon opening of the pages of a folder, move out of the plane in which they lie into a raised position in a central location between the two pages of the folder. Articles of this nature have been used to promote a particular product or service and are often used together with accompanying text in order to illustrate a particular theme or incident in a story. Although the value of such an item as an illustration is obvious, in an advertising or a promotional item, the value lies in its ability to attract attention and influence remembrance of the recipient whose business the pop-up is designed to attract. Accordingly, commercially practical items of this general type which incorporate attention-getting features remain in demand, along with ways for mass producing such items so as to make distribution economically feasible.

Because of their attention-getting raising action, pop-ups are being used with greater frequency in magazines and the like. The pop-up inserts, when used in a magazine, are bound along the magazine's binding edge with the pop-up pages opening in the same direction as the magazine pages. Due to the bulk of the magazine pages, the left hand pages of the magazine develop a curvature as it is opened. This is a normal curvature and is not objectionable if one is merely reading the page, but this curving is detrimental to those pop-ups which erect across this center fold, or "gutter". As the left hand page, or front cover, of the pop-up curls, the pop-up refuses to erect because the fold along the base of the pop-up is not straight.

To overcome the left-hand page curling, a binding strip is often incorporated into pop-up pages. First, it moves the "gutter" away from the magazine binding edge which eases the problem somewhat. Second, it allows the inserts to be bound into books Which are "perfection" bound, which is a method whereby all the pages are simply jogged or bunched into an even stack, the binding edge is then sanded under pressure, glue is applied and the entire magazine is glued together page by page at this binding edge. A cover is then "wrapped around" these pages and the entire magazine is trimmed along the top, bottom and outer edges.

Across-the-gutter type pop-ups have an additional disadvantage. The display of the across-the-gutter type pop-ups is shown against or on top of the two facing pages. This can be somewhat awkward to a reader normally accustomed to looking at either the left or the right page when reading a magazine or similar item. A pop-up displayed against the left or the right hand page will appear to be more natural to the reader and, accordingly, will be given greater consideration than those appearing across the centerfold of the magazine.

As opposed to a single-display pop-up, some pop-ups utilize two pop-up display elements, that is, one pop-up display element placed on top of the other pop-up display element thus producing an effect of a foreground and a background to the display. The added weight of the additional display element further aggravates the curling effect of the opening of the left hand page and additionally hampers the across-the-gutter type pop-up's raising action.

Finally, pop-ups in the prior art which utilize two display elements use, as an erection means, the turning of the left hand page, or front cover, to lift the top, or foreground, pop-up display element away from the bottom, or background, pop-up display element and the right hand page, or back cover. This is accomplished because the foreground display element is attached to the front cover. The foreground display element then, in turn, lifts the background display element away from the back cover via an attachment means, i.e., glue, tape, staples, etc. The most popular attachment means for the paper pop-up devices is the use of glue or cement because of their ease of application, low cost, and adhesive properties. The two pop-up elements are restrained from rotating a full one-hundred eighty degrees with the front cover and allowed to remain parallel to the back cover plane, its intended position, by another attachment, connected between the back cover and the background display element.

The attachment between the foreground and background display elements has been accomplished by gluing a spacer therebetween but this presents a number of problems. It complicates the gluing process by adding an additional surface upon which the glue must be applied (if glue is used, as is most likely). This slows the gluing and thus the manufacturing process. It also possibly reduces the gluing process to a manual application instead of an automatic application. This would naturally increase the cost of such devices.

The present invention is designed to overcome the limitations that are attendant upon the use of traditional pop-up devices, and, toward this end, it contemplates the provision of a novel pop-up device which is capable of fabrication by mechanical mass-production and which works well as a magazine insert.

It is an object of the invention to provide a pop-up device which utilizes a foreground and a background display which is visible on one page only and does not require a binding strip due to left page curvature but may utilize one if desired.

It is also an object to provide such a device whose foreground and background display elements are not attached to each other which thereby simplifies the pop-up's manufacturing process.

A further object is to provide such a device which may be readily and economically fabricated and will enjoy a long life in operation.

SUMMARY OF THE INVENTION

It has now been found that the foregoing and related objects can be readily attained in a pop-up device which can be mechanically mass-produced and assembled. The pop-up device, upon the opening of the pages of a folder, moves out of the plane in which it lies into a raised position within the two pages of the folder. These devices can be used as promotional items in advertising leaflets or mailers, or within magazines and other publications. The pop-up device includes two covers, a front and a back, which sandwich two pop-up elements, although a plurality of elements may be utilized. The pop-up elements may be cut in any shape including those shapes which utilize a tear-off coupon. The covers are bound along a common seam and are allowed to open and close along this seam.

The two pop-up elements, a foreground and a background, are hingedly connected to the front cover near and along the common seam of the front and back covers. As the front cover is opened, the pop-up elements are pulled in a direction tangential to the turning arc of the front cover.

A spacing tab is utilized in the pop-up device to force a specified spacing between the two pop-up elements and the back cover when the covers are opened. It also restrains them from turning with the front cover a full one hundred eighty degrees (180°). The specified spacing should allow the foreground pop-up element to appear somewhat closer to the viewer than the background pop-up element. The spacing tab is attached from the back cover to the background pop-up element directly and from the back cover to the foreground pop-up element via a feedthrough aperture which is incised in the background pop-up element. The spacing tab may be constructed either from the back cover or from the pop-up elements and is attached using an adhesive, normally glue.

The pop-up device, being designed for mechanical mass-production and assembly, is formed using web press production methods. These production methods perform die-cutting, scoring, gluing, plowing, and folding steps to a web until it is formed into the desired pop-up device. This can be done at very high speeds and is economically efficient.

The invention will be more fully understood when reference is made to the following detailed description taken in conjunction with the accompanying drawings.

DETAILED DESCRIPTION OF THE PREFERRED EMBODIMENTS

Description of the First Embodiment

Figure 1:
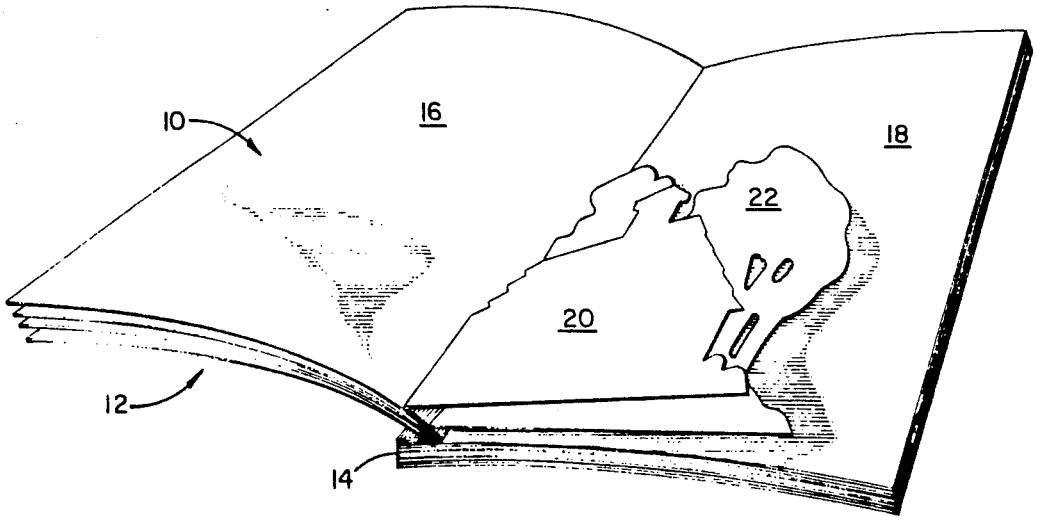
FIG. 1 is a perspective view of a first embodiment of a pop-up assembly embodying the present invention.

Referring first to FIG. 1, therein is illustrated a pop-up device, generally indicated by numeral 10, for use in a magazine, generally indicated as by numeral 12, for promotional or illustrative purposes. The pop-up 10, it should be noted, may be used in advertising mailers, inserts, greeting cards, children's books and for any other use where the attention of the recipient is desired. The pop-up 10 is held in the magazine 12 along a magazine binding edge 14, as are all other magazine pages. The pop-up 10 is comprised basically four components: two hinged base panels (a front cover 16 and a back cover 18) and two pop-up elements (a foreground pop-up element 20 and a background pop-up element 22). When the pop-up device 10 is in a closed position, all of the components lie atop one another.

The pop-up 10 becomes erect, that is, both the foreground and the background pop-up elements 20, 22 extend away from the back cover 18, when the front cover 16 is turned, as is done when reading. This is the open position as will be described in more detail hereinbelow.

Figure 2:
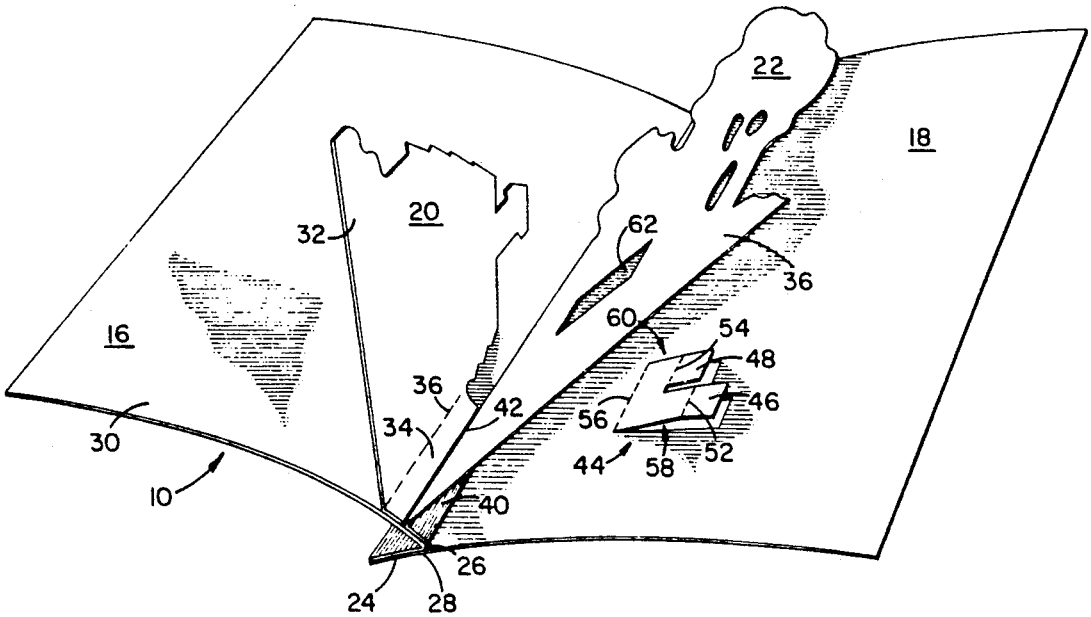
FIGS. 2 and 3 are perspective views of the pop-up assembly, as embodied in FIG. 1, of the present invention shown partially assembled.
Figure 6:
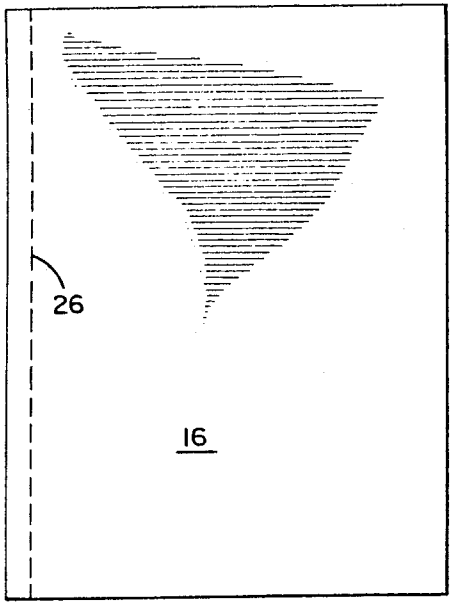
Figure 11:
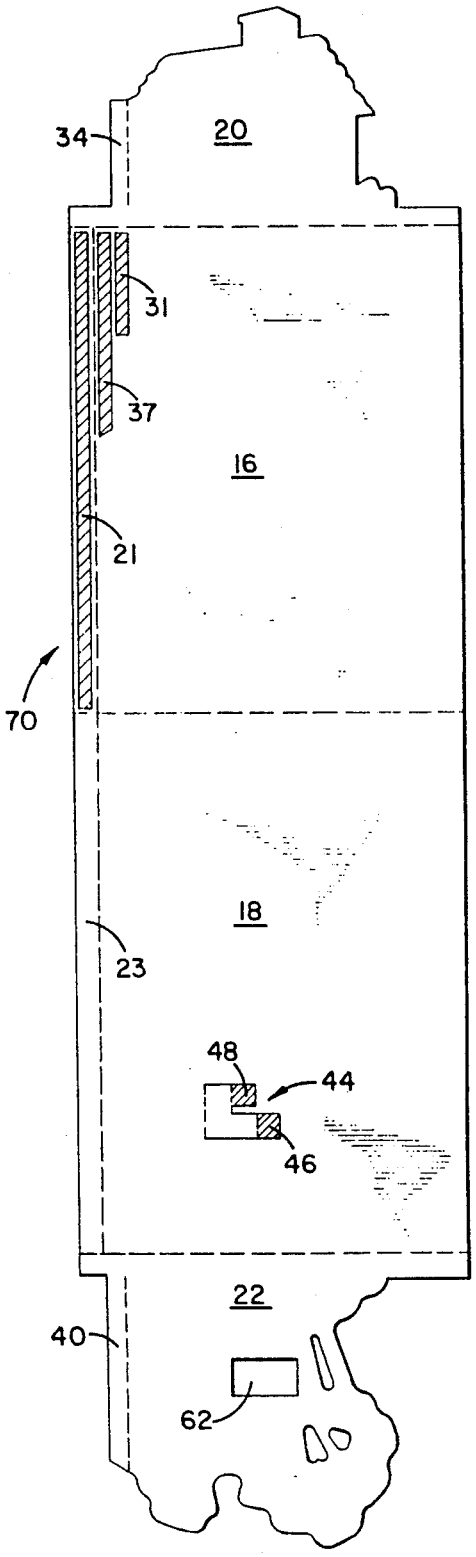

Turning now to FIG. 2, therein is illustrated in detail the pop-up device 10 made in accordance with the present invention shown partially assembled. The front and back covers 16, 18 are joined at a binding edge 24, both the front and back covers 16, 18 having a line of weakness 26, 28, respectively, along the binding edge 24. These lines of weakness 26, 28 can be seen more clearly in FIGS. 6, 9, respectively, and permit the covers 16, 18 to be conveniently folded therealong. Each line of weakness may be made by scoring, by indenting, by perforating, or by any other method to produce a line of weakness. The front and back covers 18 make actual surface-to-surface contact in cover glue zones 21, 23, which zones can be seen in FIG. 11. Referring back to FIG. 2, the foreground and background pop-up elements 20, 22 are attached to an inner surface 30 of the front cover 16 along the binding edge 24 in glue zones 31, 37, respectively, which zones are illustrated in FIG. 11. The pop-up elements 20, 22 may be attached by using preferably an adhesive such as glue or cement, but also by stapling, or by any other attachment means.

Figure 8:
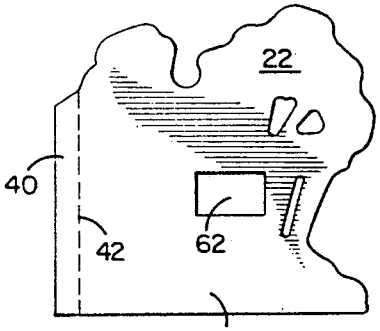
Figure 7:
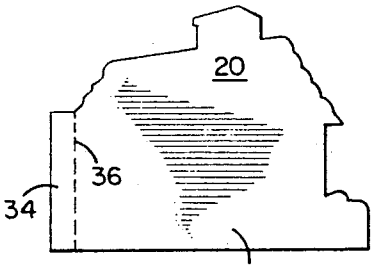

As can be seen in FIGS. 7 and 8, each of the pop-up elements 20, 22 consists of two sections: a display element section 32, 38 and a glue flap section 34, 40. Each display element 32, 38 is joined with its corresponding glue flap 34, 40 by a line of weakness 36, 42. Each glue flap 34, 40, when the pop-up device 10 is assembled, is attached to its mating glue zone 31, 37 on the front cover 16 as described above. Again, these glue zones 31, 37 are shown in FIG. 11.

Figure 16:
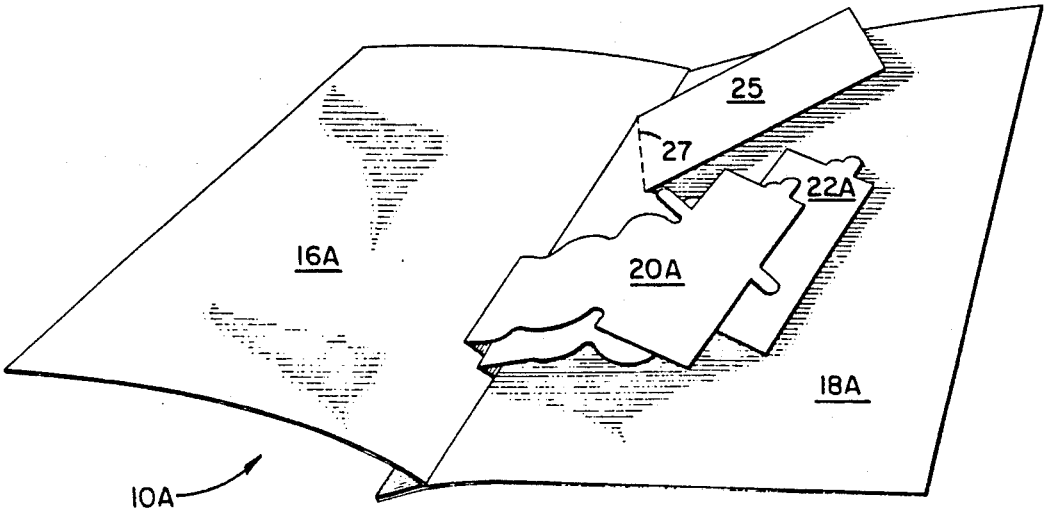
FIG. 16 is a perspective view of a second embodiment of the same invention.
Figure 23:
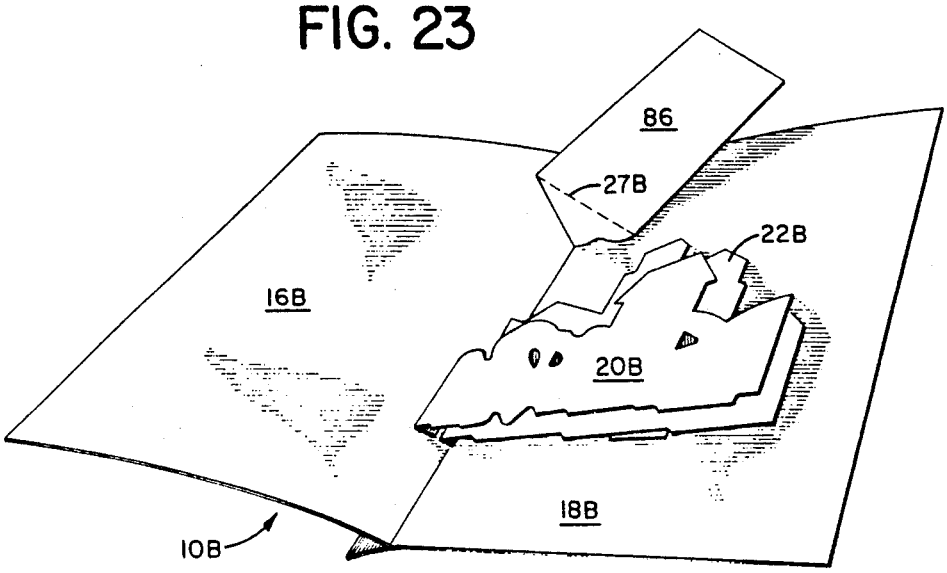
FIG. 23 is a perspective view of a third embodiment of the same invention.

The pop-up elements 20, 22, which form the pop-up device 10, may be formed into any two-dimensional shape to produce the desired optical effect. FIG. 1 shows a house (foreground pop-up element 20) in the foreground with trees (background pop-up element 22) as a backdrop. FIG. 16 illustrates a second embodiment of the present invention, which utilizes the same effect, using pop-up elements 20A and 22A shaped as cigarette packages. Additionally, either pop-up element 20A or 22A may be constructed to include an auxiliary coupon 25 as shown in FIG. 16. Although the auxiliary coupon 25 is normally rectangular, it may be of any shape so long as it is detachable, normally via a perforated line 27, from its associated pop-up element. Furthermore, as shown in FIG. 23, a pop-up device 10B of a third embodiment may be constructed, such that a pop-up element 86 is itself a detachable coupon. This is accomplished by perforating the appropriate pop-up element line of weakness. In the various embodiments, the pop-up elements as well as the coupons and covers are printed to form an attractive presentation to the user.

Figure 9:
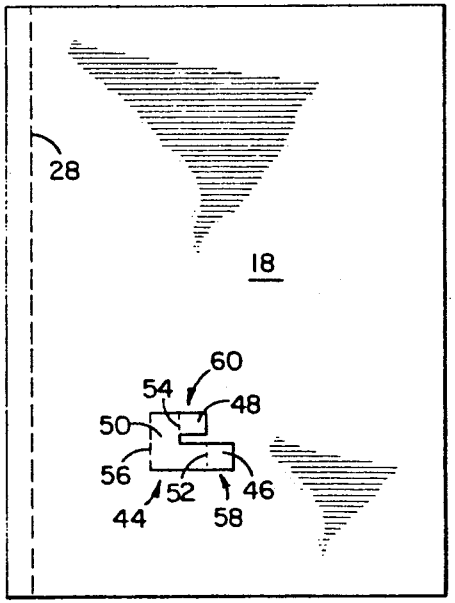
FIGS. 6, 7, 8 and 9 are top elevational views of a front cover element, a foreground pop-up element, a background pop-up element, and a back cover element, respectively, from the pop-up device, as embodied in FIG. 1, of the present invention.

Referring to FIG. 9, it can be seen that the back cover 18 incorporates a spacing tab, generally indicated by numeral 44, for the purpose of spacing the foreground pop-up element 20, the background pop-up element 22, and the back cover 18 when the pop-up device 10 is in the open position. Although there are other methods of effectuating a spacing tab, the spacing tab 44 is ideally formed from the back cover 18, that is, incised from the panel 18 excepting one area in which a line of weakness 56 is formed. This line of weakness 56 allows the spacing tab 44 to move away from the back cover 18 thus providing the appropriate amount of spacing.

Still referring to FIG. 9, the spacing tab 44 is comprised of an L-shaped spacing body 50 and first and second spacing glue flaps 46, 48. The spacing body 50 shares a line of weakness 52 with the first spacing glue flap 46. This forms a first spacing tab arm, indicated generally by numeral 58. The spacing body 50 also shares a line of weakness 54 with the second spacing glue flap 48. This forms a second spacing tab arm, indicated generally by numeral 60. The two spacing tab arms 58, 60, are situated parallel to one another with the first spacing tab arm 58 extending slightly longer than the second spacing tab arm 60 to ensure that the foreground pop-up element 20 is spaced further from the back cover 18 than the background pop-up element 22 when the pop-up device 10 is in an open position. The spacing body 50, in turn, shares a common line of weakness 56 with the back cover 18, as previously mentioned.

Figure 3:
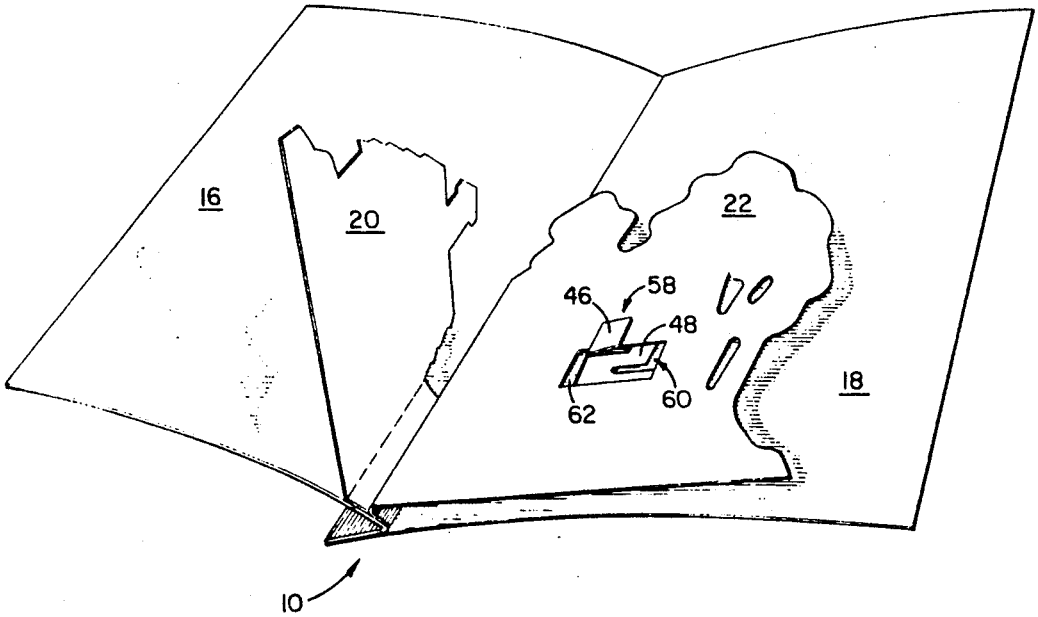

Referring to FIG. 2, it can be seen that the background pop-up element 22 provides a feedthrough aperture 62. As can be seen most clearly in FIG. 3, the feedthrough aperture 62 is positioned in the background pop-up element 22 such that when the pop-up device 10 is in a closed position, the first spacing tab arm 58 extends through the aperture 62 to be attached to the foreground pop-up element 20. Furthermore, the bulk of second spacing tab arm 60 is covered by the background pop-up element 22. An adhesive or another attachment means is utilized to secure the second spacing glue flap 48 to the background pop-up element 22. The first spacing glue flap 46 is then attached to the foreground pop-up element 20 thus configuring the pop-up device 10 as shown in FIG. 1.

Figure 4:
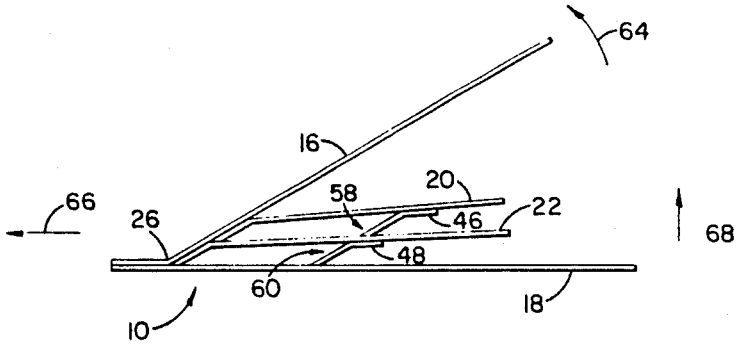
FIGS. 4 and 5 are side elevational views of the pop-up assembly of the present invention showing the device, as embodied in FIG. 1, shown opened at angles of approximately thirty degrees (30°) and one hundred fifty degrees (150°) respectively.
Figure 5:
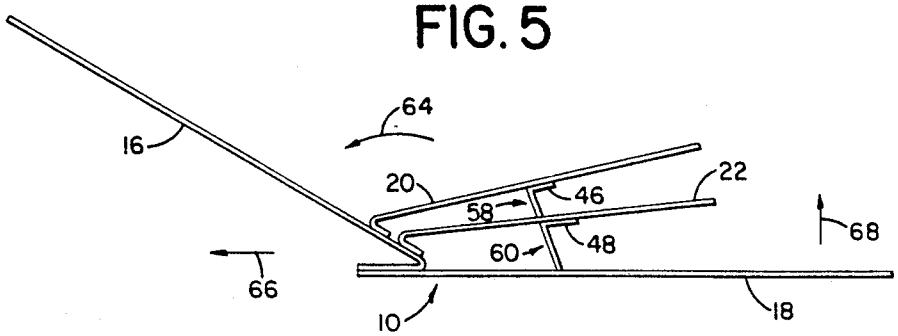

When the pop-up device 10 is in the closed position, all of the components lie atop one another, that is, the background pop-up element 22 lies atop the back cover 18, the foreground pop-up element 20 lies atop the background pop-up element 22 and the front cover 16 lies atop the foreground pop-up element 20. As shown in FIGS. 4 and 5, the front cover 16 is rotated in a counterclockwise direction, as indicated by arrow 64, about the front cover line of weakness 26 with the back cover 18 remaining flat. This allows the foreground and background pop-up elements 20 and 22 to move in two directions: in a direction, as indicated by arrow 66, parallel to the plane of back cover 18 and in a direction, as indicated by arrow 68, perpendicular to the plane of back cover 18. This results in a visually pleasing raising action of the pop-up device.

Description of First Assembly Method

A desired method for making the pop-up device of the first embodiment must be susceptible to being carried out on automatic cutting and assembly machinery and thus render these items particularly attractive in the promotional and advertising fields where the ability to reach the mass market at reasonable prices is most important. FIGS. 10–15 illustrate the making of the pop-up device as it moves through automatic machinery which cuts and assembles the pop-up devices.

Figure 10:
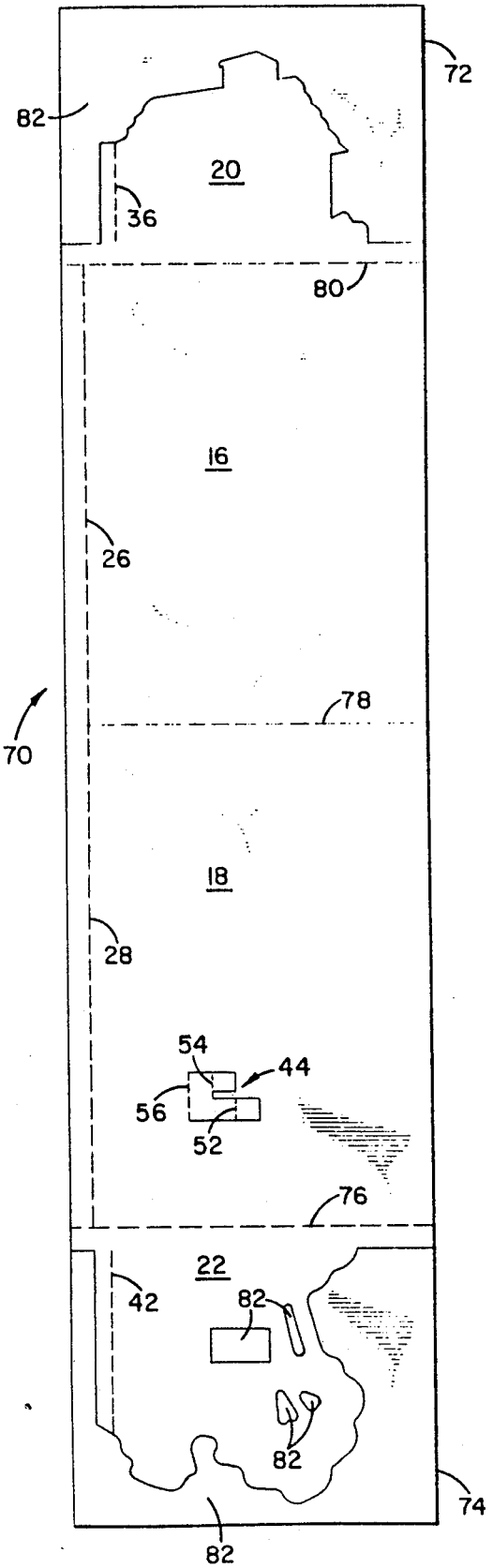
FIGS. 10 to 15 are top elevational views of the pop-up device, as embodied in FIG. 1, of the present invention shown during different steps of a first fabrication process.

Referring first to FIG. 10, therein is illustrated a blank or web, indicated generally by numeral 70, of which the pop-up device is to be made. After perforating, scoring and die-cutting steps, the web 70 is formed with a number of perforated lines, scored or indented lines, and incisions. First, second, and third perforated lines 76, 78, 80 join a background display section 74, the back cover 18, the front cover 16, and a foreground display section 72. During the scoring process, front and back cover lines of weakness 26, 28 as well as the foreground and background pop-up element lines of weakness 36, 42 are formed. Additionally, the spacing tab lines of weakness 52, 54, 56 are made. Finally, during the die-cut process, the two pop-up elements 20, 22 are formed, thus leaving scrap material 82 which is removed. Likewise, appropriate incisions in the back cover 18 form the spacing tab 44.

As shown in FIG. 11, adhesive, indicated by hatching, is applied during a glue application process to various glue zones. The following five zones are those in which the adhesive is applied: the foreground spacing glue flap 46; the background spacing glue flap 48; the foreground pop-up element glue zone 31; the background pop-up element glue zone 37; and the front cover binding glue zone 21. Glue applied to these zones will allow the appropriate adhesion between the elements.

Figure 12:
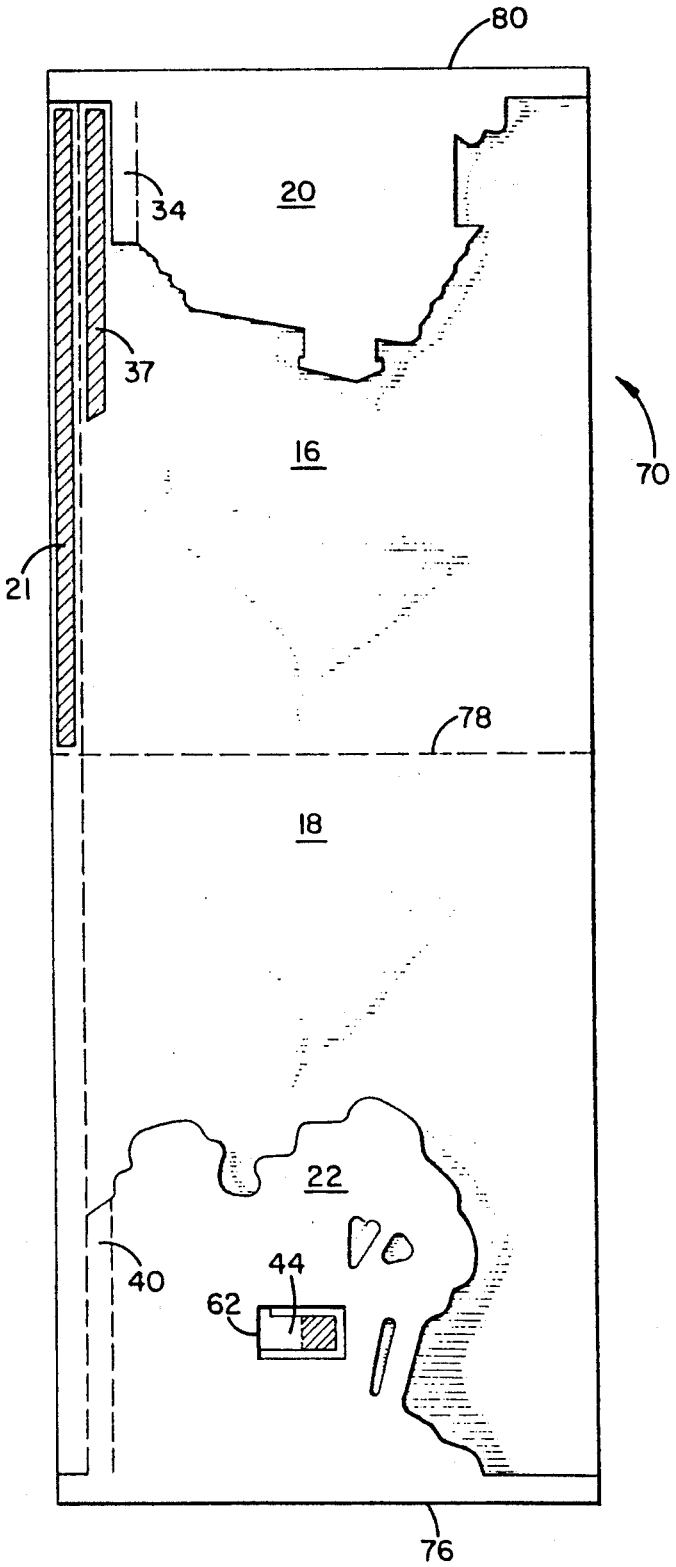
Figure 13:
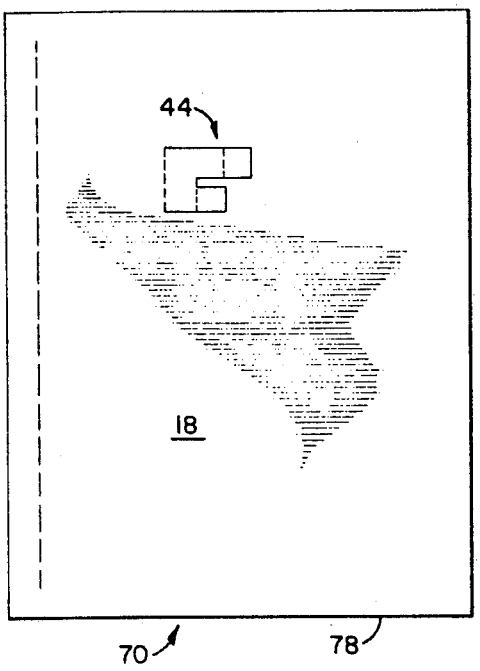
Figure 14:
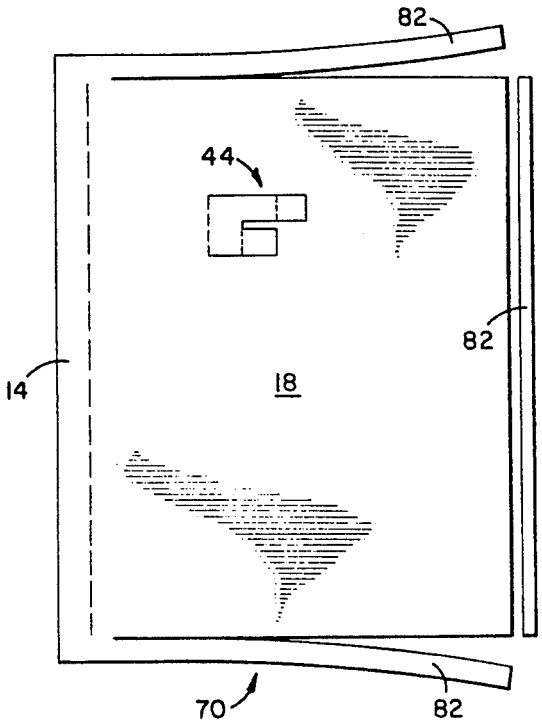
Figure 15:
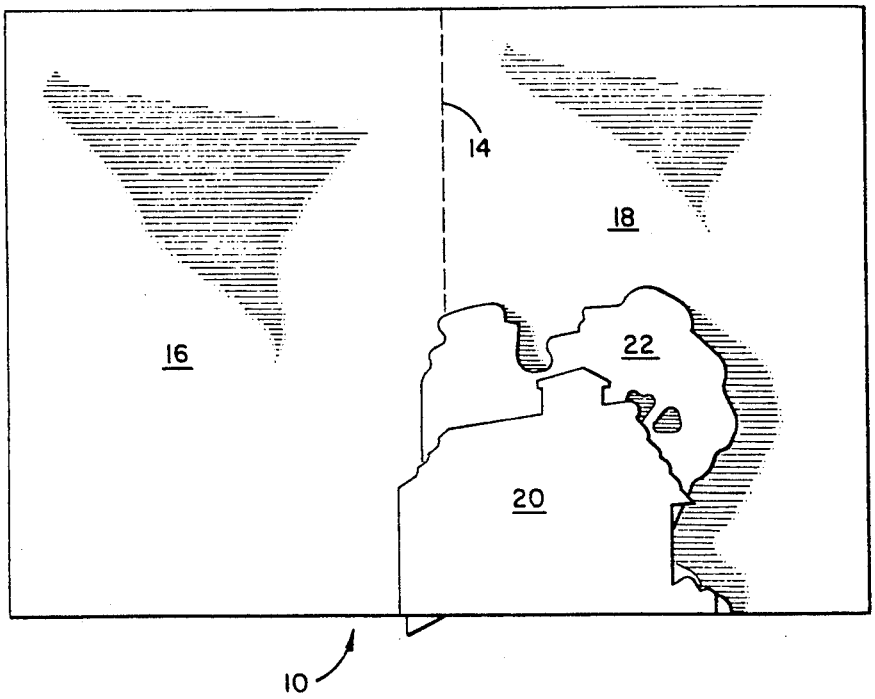

The next step is a plowing stage shown in FIG. 12, where the pop-up elements 20, 22 are folded, or plowed over along the first and third perforated line 80, 76, onto the front and back covers 16, 18, respectively. This forces an adhesion between the foreground pop-up element 20 and the front cover 16 and an adhesion between the background pop-up element 22 and the background spacing glue flap 48. As seen in FIG. 13, the web 70 is further folded, during a folding step, along the second perforated line 78, thus forcing adhesion between (1) the background pop-up element 22 and the front cover 16, (2) the front cover 16 and the back cover 18 and (3) foreground spacing glue flap 46 and the foreground pop-up element 20. The folded web 70 is shown in FIG. 13 in a bottom elevational view. Finally, during a trimming step shown in FIG. 14, the web 70 is trimmed along three of its four sides (the front and back cover junction or the binding edge 14 is not trimmed), thus forming additional scrap 82 which removed. This allows the pop-up device 10 to open along the binding edge 14 as shown in FIG. 15. As seen in FIG. 15, the assembled pop-up device 10 erects when opened as previously described.

Description of a Second Preferred Embodiment

Referring now to FIG. 16, therein is illustrated a second embodiment of the pop-up device of the present invention, generally indicated by numeral 10A. Because the first and second embodiments, as well as a third and fourth embodiments to be discussed in more detail hereinbelow, utilize many similar elements, these elements are indicated with identical numerical designations with an additional letter, A, B or C. The additional letter A will be used for like elements in the second embodiment, as B and C will be used in the third and fourth embodiments, respectively. This will facilitate the understanding of the embodiments. Similarly, three methods of assembly, the first of which has been described hereinabove, will utilize these same designations.

Referring again to FIG. 16, the pop-up device 10A has two covers, a front 16A and a back 18A, and two pop-up elements, a foreground 20A and a background 22A, similar to device 10 of the first embodiment. The pop-up elements are die-cut to form two cigarette boxes and a detachable coupon 25 (as opposed to a house with a foliage backdrop, as in the first embodiment). The detachable coupon 25 is attached to the background pop-up element 22A along a perforated line 27. It should be noted that a detachable coupon may be formed on either pop-up element, foreground or background. When opened, the pop-up device 10A operates in a manner similar to the first embodiment.

Description of Second Assembly Method

FIGS. 17 through 22 display a second method of a pop-up device mechanical mass-production. The second embodiment of the present invention described hereinabove is shown in these figures being made using this method.

Figure 17:
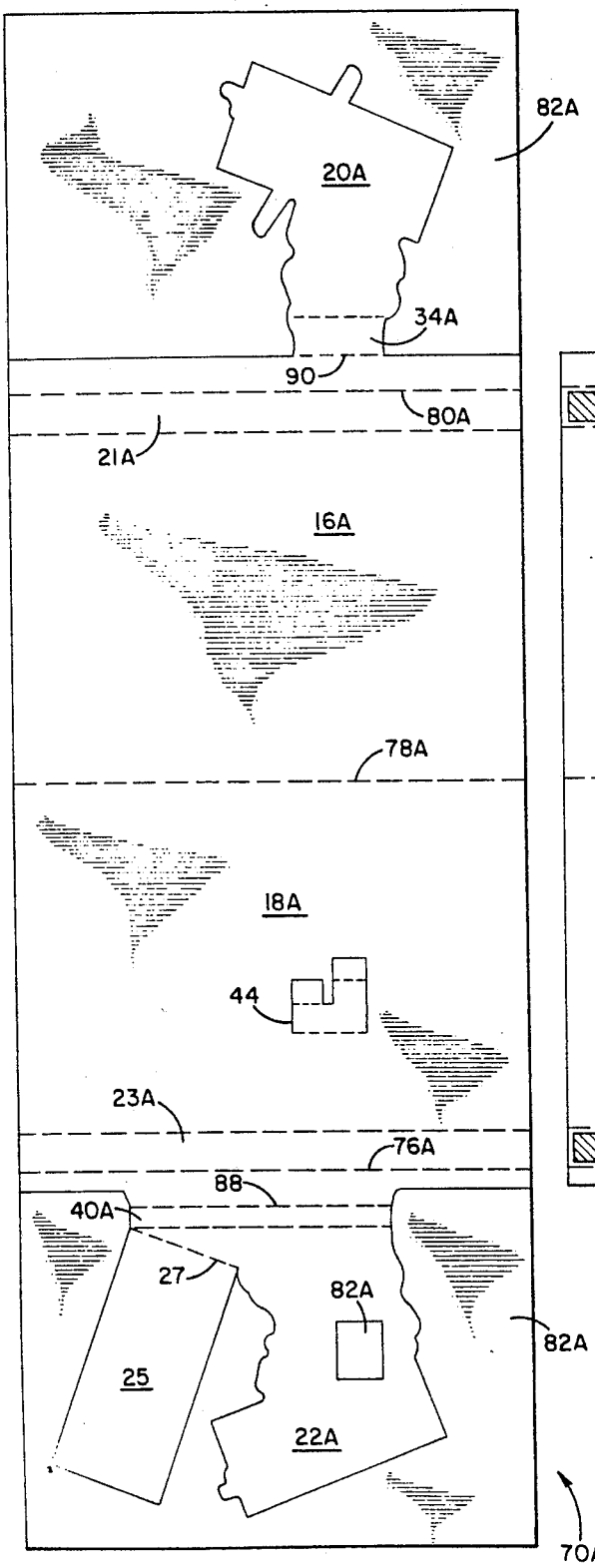

FIG. 17 illustrates a resulting web 70A after it has been perforated, scored and die-cut, as in the first assembly method. An additional perforated line 27 is incorporated in the background pop-up element 22A, thus forming a tear-off coupon 25. The tear-off coupon 25, as was described earlier, may be formed in either pop-up element and in either of the above-mentioned methods.

Additionally, because the pop-up element glue flaps 40A, 34A of pop-up elements 22A, 20A are formed parallel to the lines of perforation 76A, 78A, 80A and alongside the first and third lines of perforation 76A, 80A, respectively, two additional lines of weakness 88, 90 are required during the scoring process. Other differences in structure as compared to the first embodiment include both pop-up elements and the spacing tab 44 being rotated by ninety degrees (90°) and the front and back cover binding glue zones 21A, 23A lying parallel to the lines of perforation 80A, 76A instead of lying perpendicular as in the first embodiment.

Figure 22:
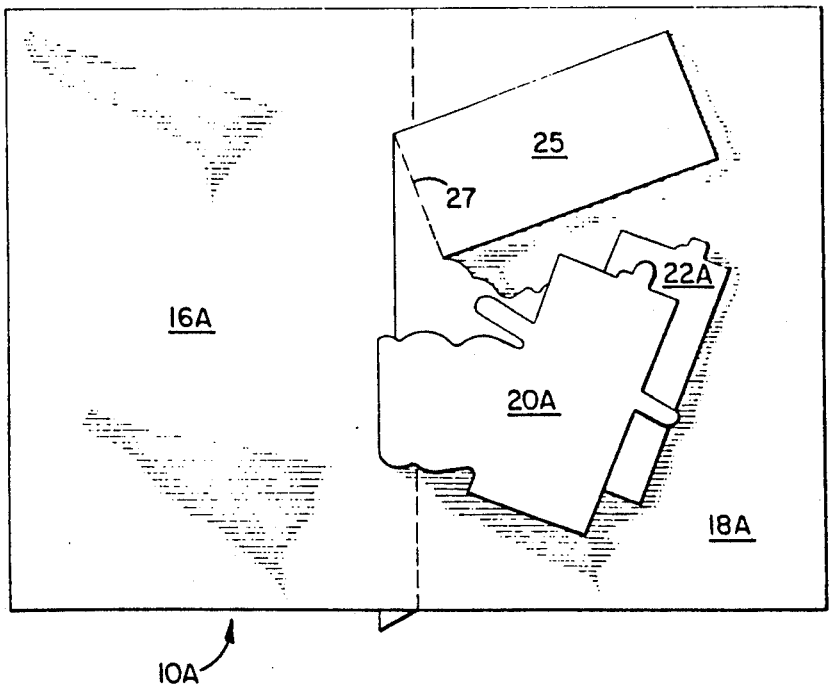
FIGS. 17 to 22 are top elevational views of the second embodiment of the present invention shown during different steps of a second fabrication process.
Figure 18:
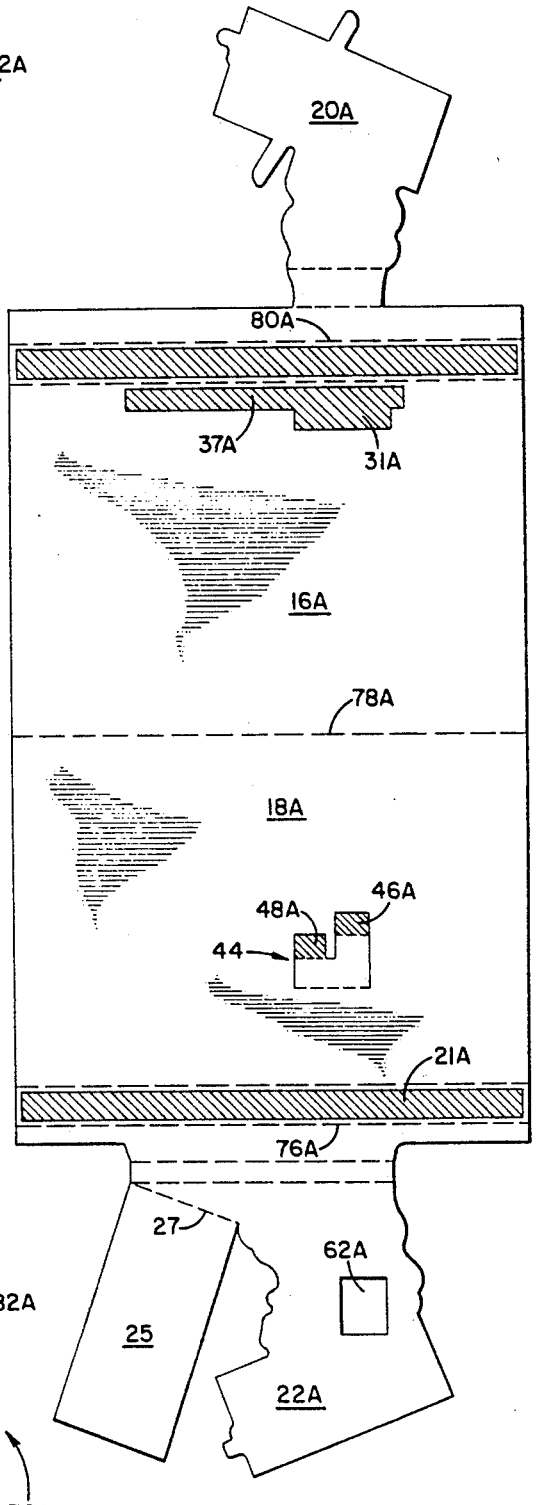
Figure 19:
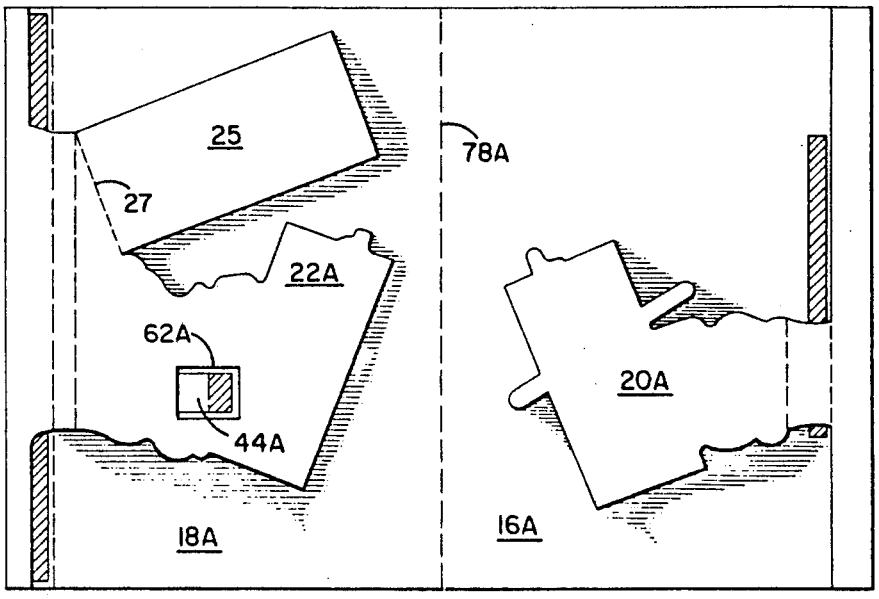
Figure 20:
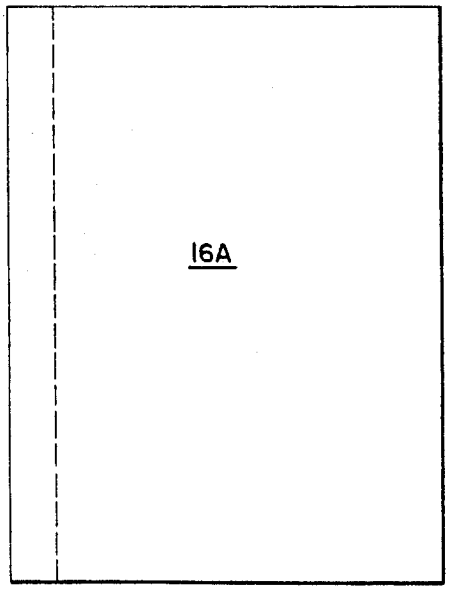
Figure 21:
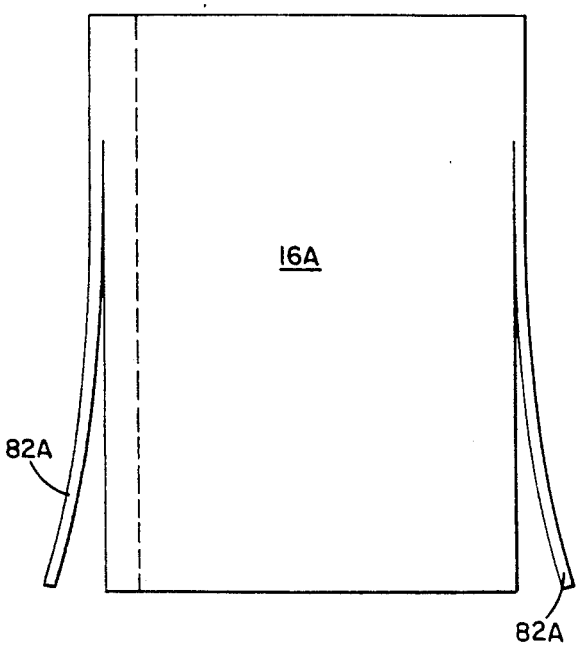

FIG. 18 illustrates the gluing process in which adhesive is applied in a similar manner as the first method, such that the appropriate adhesive attachments are made. FIGS. 19, 20 and 21 show similar plowing, folding and trimming steps. FIG. 22 illustrates the resulting pop-up device 10A in an open position.

Description of a Third Preferred Embodiment

Referring now to FIG. 23, therein is illustrated a third embodiment of the pop-up device of the present invention, generally indicated by numeral 10B. The device 10B has a front and a back cover 16B, 18B as well as foreground and background pop-up elements 20B, 22B. Additionally, the pop-up device 10B has a third pop-up element, in this case formed as a detachable coupon 86. The third pop-up element 86 may be formed as a detachable coupon 86, as shown here, or as a pop-up element similar to pop-up elements 20B, 22B. Unlike the second embodiment coupon 25, this coupon 86 is itself a pop-up element and is not formed from either the foreground or the background pop-up element 20B, 22B. The coupon 86 has a perforated line 27B along which it can be easily removed from the device for redemption by the reader. It should be noted, however, that the coupon 86 or a similar type pop-up element may be utilized in both the first and the second embodiment and may be formed utilizing either the first or second assembly method as described.

Description of Third Assembly Method

A third assembly method to be described is illustrated in FIGS. 24 through 29. As in the first and second assembly methods, perforating, die-cutting and scoring processes are performed to blank 70B in FIG. 24, resulting in a web 70B of FIG. 25. Differences in web 70B include a tear-off coupon 86, the location of the pop-up element glue flaps, and the glue zones. The glue flaps 34B, 40B are located at the outermost end of the web while the glue zones extend across a central portion of the web adjacent perforated line 78B.

Figure 29:
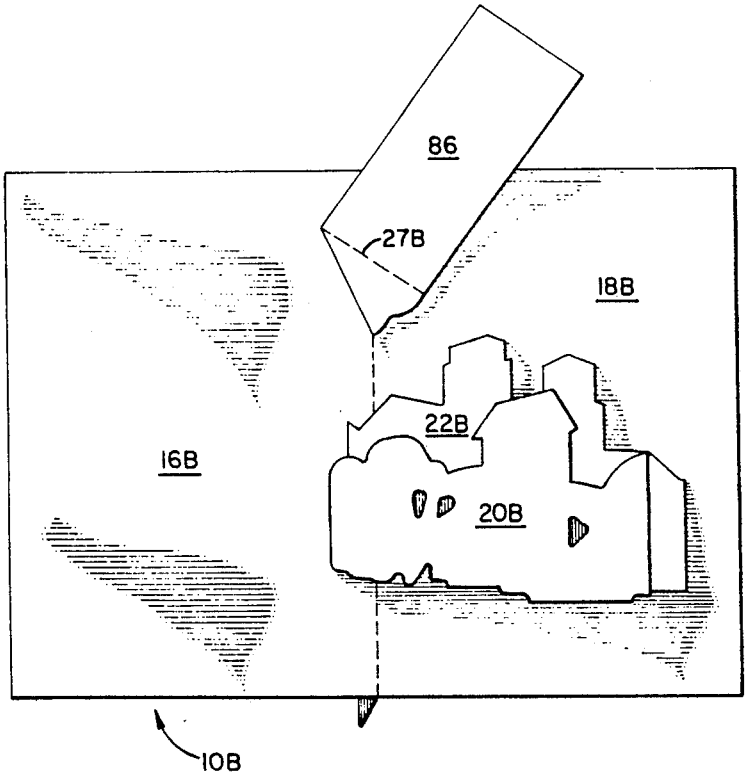
FIGS. 24 to 29 are top elevational views of the third embodiment of the present invention shown during different steps of a third fabrication process.
Figure 24:
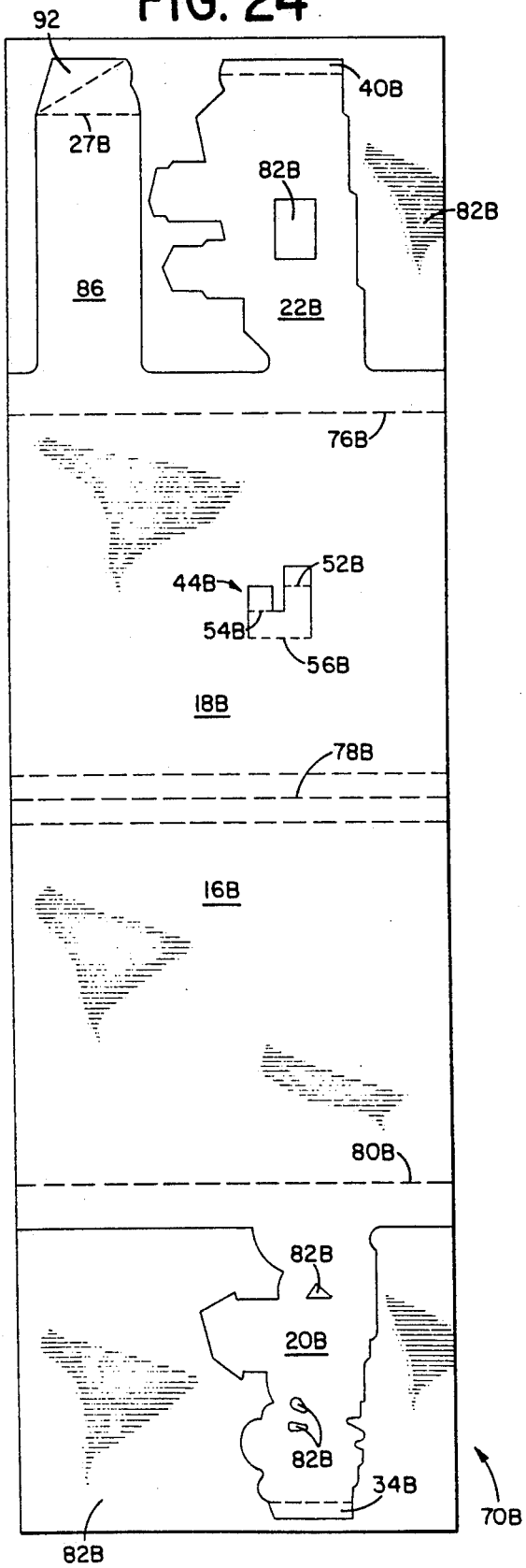
Figure 25:
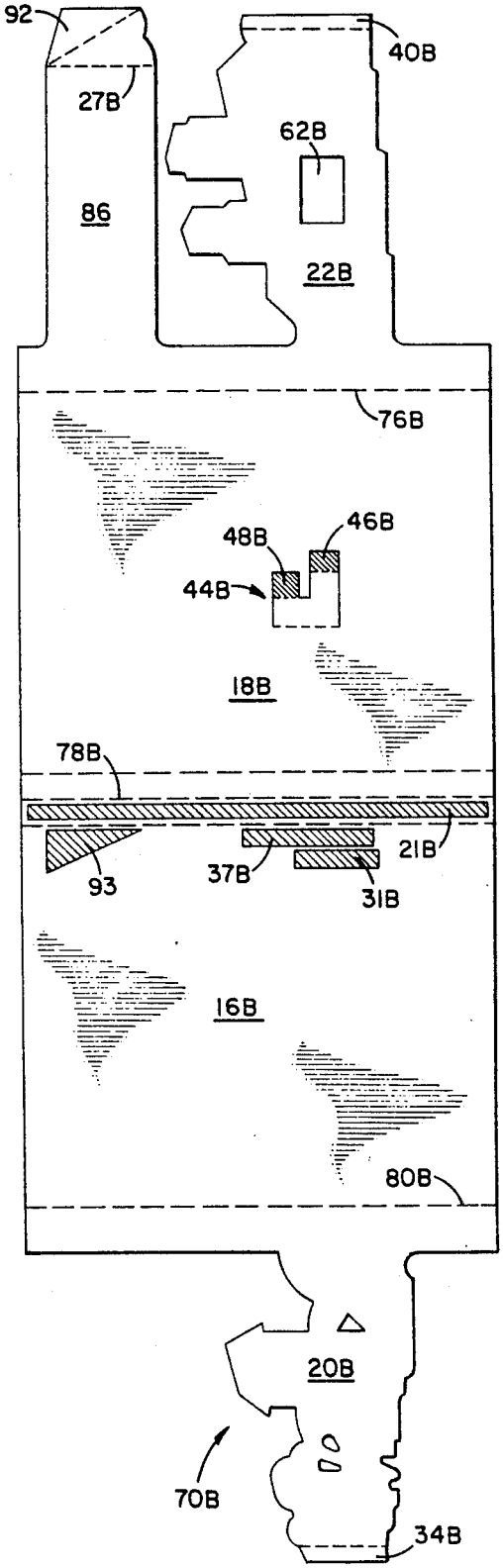
Figure 26:
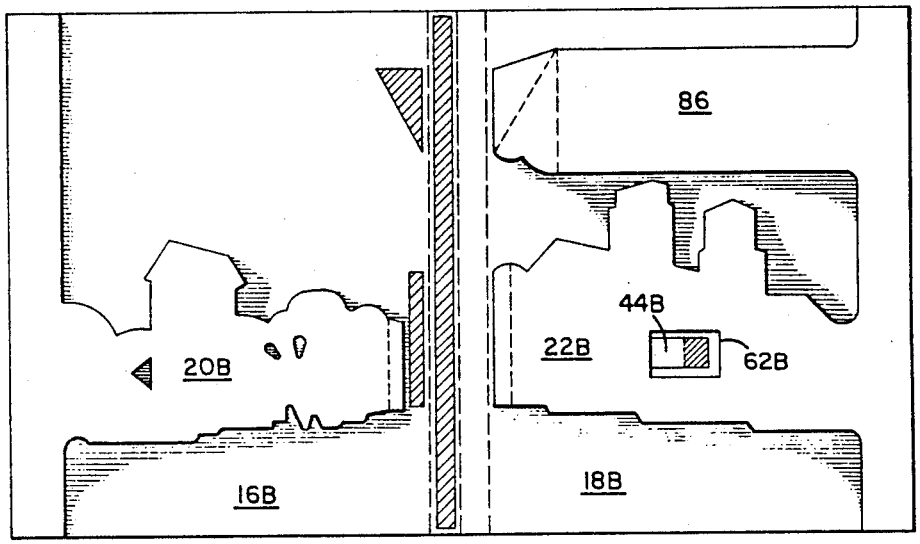
Figure 27:
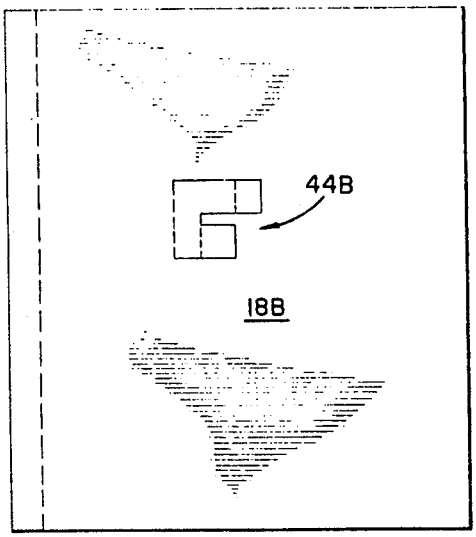
Figure 28:
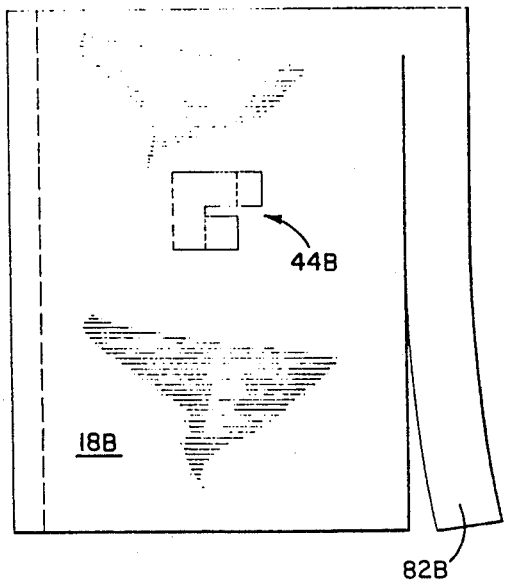

The tear-off coupon 86, as was previously described, is formed as a separate pop-up. It utilizes a perforated line 27B and glue flap 92. The coupon glue flap 92, as well as the other pop-up element glue flaps 34B, 40B are situated in the outermost portions of web 70B. Subsequently, the glue zones are located along the second line of perforation 78B for the appropriate adhesive contact. This includes an additional coupon glue zone 93. The web 70B is then plowed (FIG. 26), folded (FIG. 27), and trimmed (FIG. 28) resulting in pop-up device 10B in an open position (FIG. 29).

Description of a Fourth Preferred Embodiment

Figure 30:
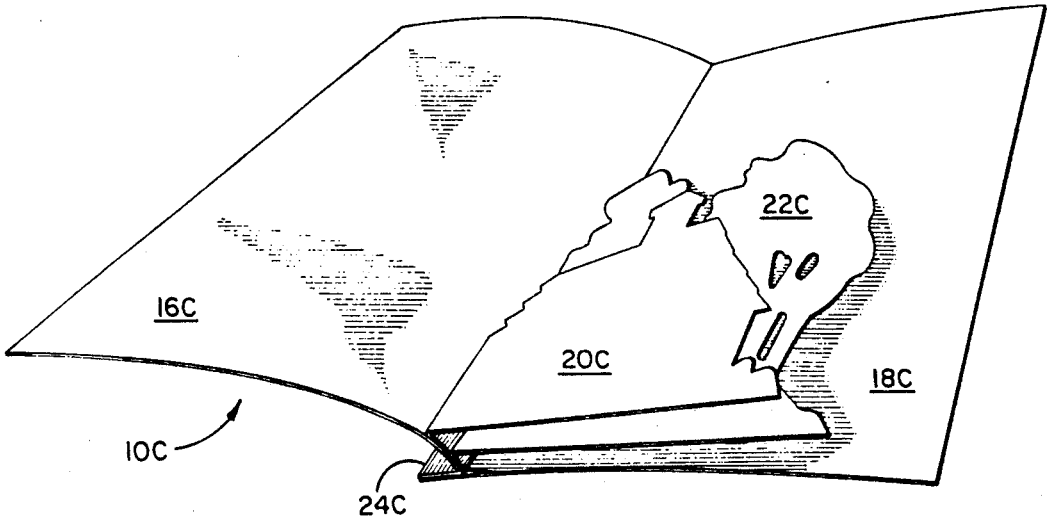
FIG. 30 is a perspective view of a fourth embodiment of the present invention.
Figure 36:
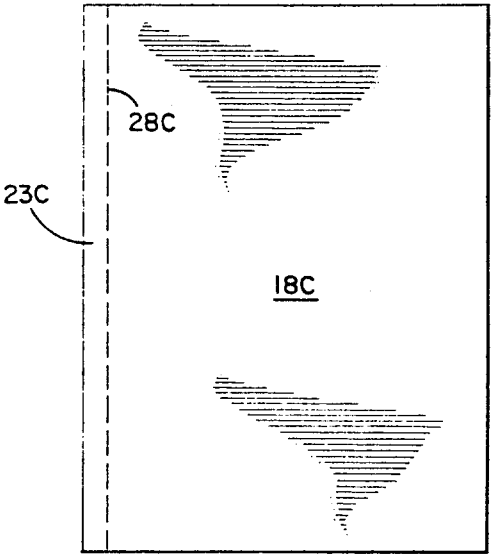
FIGS. 33, 34, 35 and 36 are top elevational views of a front cover element, a foreground pop-up element a background pop-up element, and a back cover element respectively, from the pop-up device of the fourth embodiment of the present invention.
Figure 33:
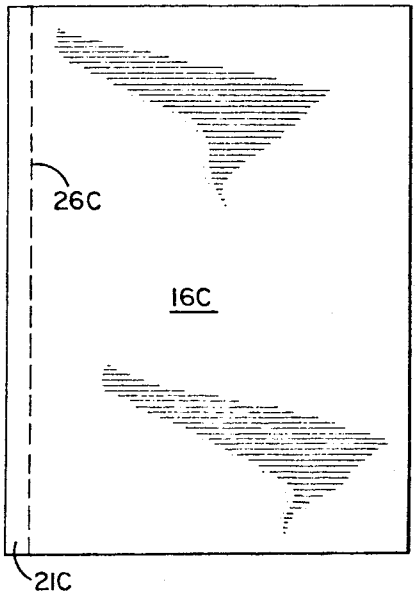

Referring to FIG. 30, therein is illustrated a fourth embodiment of a pop-up device of the same invention, generally indicated by numeral 10C. The construction of the pop-up device 10C is very similar to those embodiments previously described, with an exception of the spacing tab structure. The pop-up device 10C incorporates a front cover 16C, a back cover 18C, and foreground and background pop-up elements 20C and 22C. The front and back covers 16C and 18C are joined along a binding edge 24C in binding glue zones 21C and 23C, which are shown in FIGS. 33, 36. Each cover may be partially rotated about its corresponding line of weakness 26C and 28C.

Figure 31:
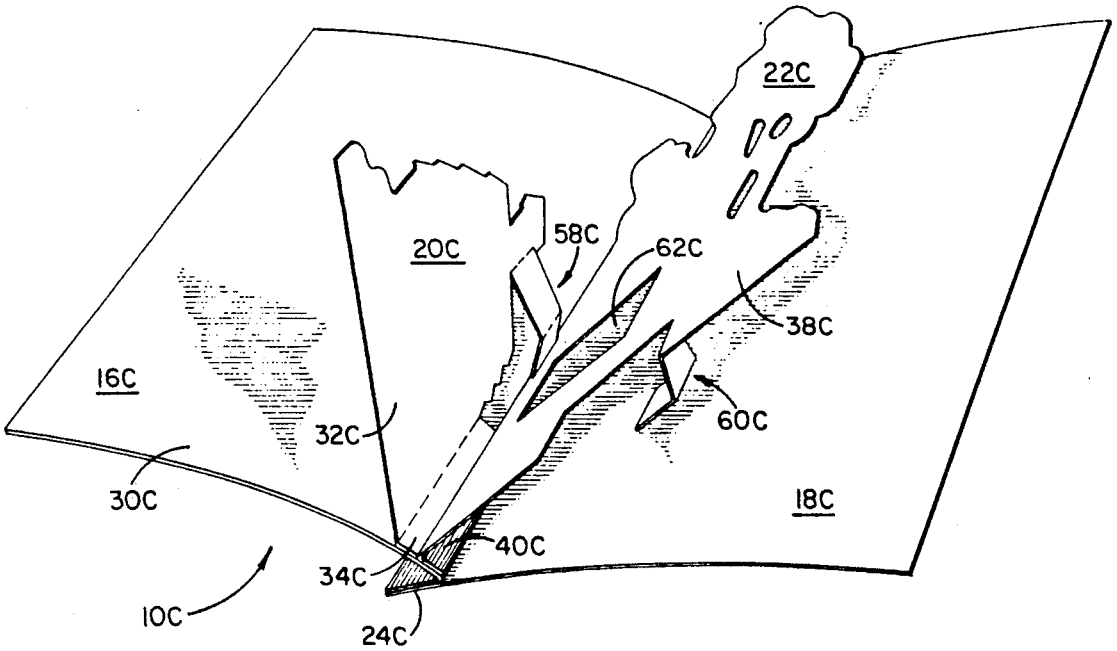
FIGS. 31 and 32 are perspective views of the fourth embodiment of the pop-up assembly of the present invention shown partially assembled.
Figure 32:
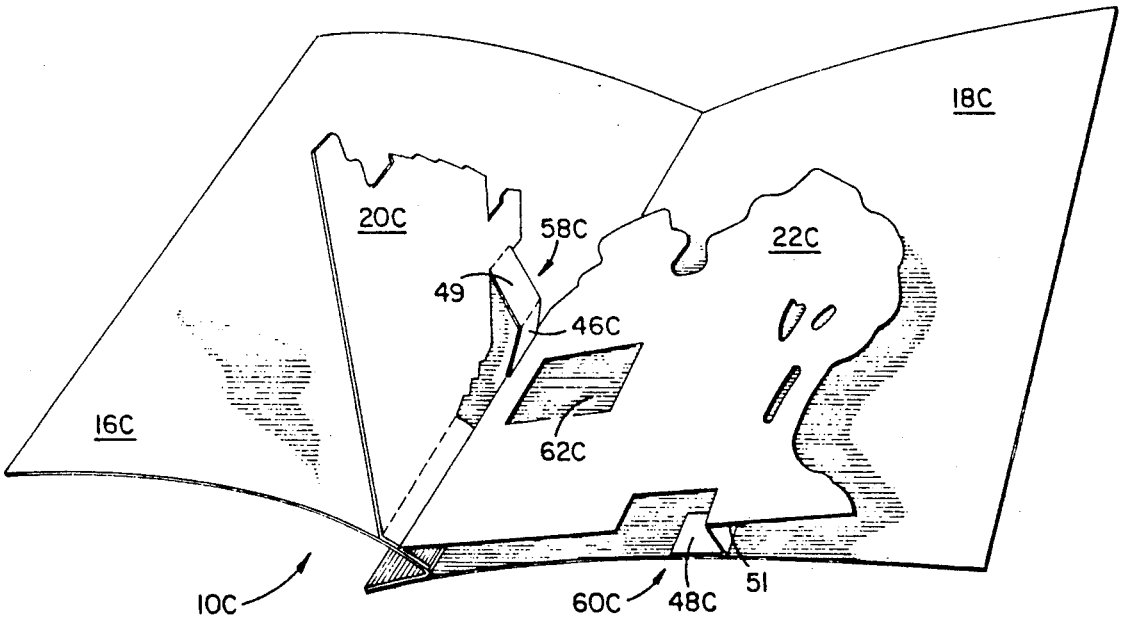
Figure 35:
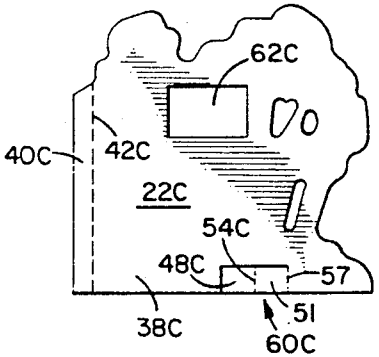
Figure 34:
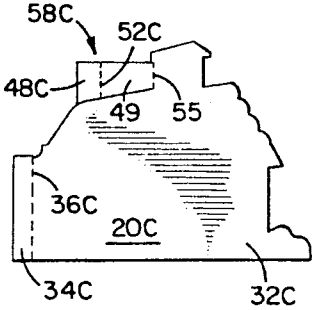

As can be seen in FIG. 31, each pop-up element 20C, 22C consists of three sections a display element section 32C, 38C, a glue tab section 34C, 40C, and a spacing tab arm section, generally indicated as 58C, 60C. As shown in FIGS. 34 and 35, each display element 32C, 38C is joined to its corresponding glue flap 34C, 40C by a line of weakness 36C, 42C. Similarly, each display element 32C and 38C is joined to its corresponding spacing tab arm 58C, 60C, by a line of weakness 55, 57. In addition, the background pop-up element 22C provides a feedthrough aperture 62C. As can be seen in FIG. 32, the feedthrough aperture 62C is positioned in the background pop-up element 22C such that when the pop-up device 10C is in a closed position, the spacing tab arm 58C is allowed to feed through to and attach to the back cover 18C.

As can be seen in FIG. 32 and as was previously mentioned, both the foreground and background pop-up elements 20C, 22C incorporate spacing tab arms 58C, 60C for the purpose of spacing the pop-up elements 20C, 22C from the back cover 18C when the pop-up device 10C is in an open position. Each spacing tab arm 58C, 60C is comprised of two sections: a spacing tab arm glue flap 46C, 48C and a spacing tab arm body 49, 51. As shown in FIGS. 34, 35, each spacing tab arm glue flap 46C, 48C is attached to its corresponding spacing tab arm body 49, 51 by a line of weakness 52C, 54C. Similarly, each spacing tab arm body 49, 51 is attached to its associated pop-up element 20C, 22C by a line of weakness 55, 57 as was previously described. Each spacing tab arm 58C, 60C is similarly shaped and sized with an exception that the foreground spacing tab arm body 49 is longer than the background spacing tab arm body 51. This difference will ensure that the foreground pop-up element 20C will be spaced further from the back cover 18C than the background pop-up element 22C when the pop-up device 10C is in an open position. An adhesive is used to attach both spacing tab arm glue flaps 46C and 48C to the back cover 18C thus configuring the pop-up device 10C as shown in FIG. 30.

As will be appreciated by those skilled in the art, the fourth embodiment may be assembled using the first, second or third assembly method herein described above. It should be noted and understood that any of the above specified embodiments may be assembled using these assembly methods. Furthermore, other embodiments not specifically depicted herein may be formed, such as a multi-pop-up element device (i.e., greater than two pop-up elements), using the same concepts detailed herein.

Thus it can be seen from the foregoing specification and attached drawings that the pop-up device of the present invention provides an effective device which is capable of mechanical mass-production and assembly and works well in magazine inserts. The pop-up illustrates a two-layered display on one page only without the need for binding strips or the need for the two displays to be attached to each other.

The preferred embodiments admirably achieve the objects of the present invention; however, it should be appreciated that departures can be made by those skilled in the art without departing from the spirit and scope of the invention which is limited only by the following claims.

Having thus described the invention, what is claimed is:

1. A pop-up device comprising:

(A) a base piece which includes a front cover and a back cover, each having a lateral edge which lies generally along a common line along which said covers can be folded between an open position and a closed superimposed position;

(B) a plurality of pop-up elements, each hingedly attached to said front cover along a hinge line spaced away from said common line, at least one of said pop-up elements having means forming a feedthrough aperture therein extending therethrough; and (C) tab means for spacing said pop-up elements from one another and from said back cover when said front cover and said back cover are in said open position, said tab means having a first portion attaching between said back cover and one of said pop-up elements, and having a second portion extending through said at least one feedthrough aperture and attaching between said back cover and the remainder of said pop-up elements.

2. The pop-up device in accordance with claim 1, wherein said pop-up elements are a foreground pop-up element and a background pop-up element, said background pop-up element having said feedthrough aperture therein.

3. The pop-up device in accordance with claim 2, wherein said tab means is a portion of said back cover.

4. The pop-up device in accordance with claim 3, wherein said tab means comprises first and second arms wherein said first arm is attached to said foreground pop-up element and said second arm is attached to said background pop-up element, and said first arm is longer than said second arm.

5. The pop-up device in accordance with claim 4, wherein said first arm has a line of weakness at substantially two-thirds of its total length and said second arm has a line of weakness at substantially one-half of its total length.

6. The pop-up device in accordance with claim 5, wherein said first and second arms attach to said foreground and background pop-up elements utilizing an adhesive.

7. The pop-up device in accordance with claim 2, wherein said tab means includes a foreground pop-up element tab for said foreground pop-up element, said foreground pop-up element tab being a portion of said foreground pop-up element.

8. The pop-up device in accordance with claim 7, wherein said foreground pop-up element tab extends through said feedthrough aperture between said foreground pop-up element and said back cover.

9. The pop-up device in accordance with claim 7, wherein said foreground pop-up element means attaches to said back cover utilizing an adhesive.

10. The pop-up device in accordance with claim 7, wherein said tab means includes a background pop-up element tab for said background pop-up element, said background pop-up element tab being a portion of said background pop-up element.

11. The pop-up device in accordance with claim 10, wherein said background pop-up element tab extends between said background pop-up element and said back cover.

12. The pop-up device in accordance with claim 10, wherein said background pop-up element tab attaches to said back cover utilizing an adhesive.

13. The pop-up device in accordance with claim 2, wherein said tab means includes a background pop-up element tab for said background pop-up element, said background pop-up element tab being a portion of said background pop-up element.

14. The pop-up device in accordance with claim 13, wherein said background pop-up element tab extends between said background pop-up element and said back cover.

15. The pop-up device in accordance with claim 2, wherein said foreground and background pop-up elements are situated such that when said covers are in a closed position, said pop-up elements are sandwiched between said covers, said foreground pop-up element making surface-to-surface contact with said front cover and said background pop-up element, and said background pop-up element making surface-to-surface contact with said foreground pop-up element and said back cover.

16. The pop-up device in accordance with claim 15, wherein said foreground and background pop-up elements each include a glue flap and a display element, each having a lateral edge which lies generally along a common line of weakness.

17. The pop-up device in accordance with claim 16, wherein said foreground and background pop-up elements glue flaps attach to said front cover.

18. The pop-up device in accordance with claim 17, wherein said foreground and background pop-up elements glue flaps attach to said front cover utilizing an adhesive.

19. The pop-up device in accordance with claim 2, wherein said foreground pop-up element includes a display element and a coupon, each having a lateral edge which lies generally along a common line of perforation.

20. The pop-up device in accordance with claim 2, wherein said background pop-up element includes a display element and a coupon, each having a lateral edge which lies generally along a common line of perforation.

21. The pop-up device in accordance with claim 1, wherein said pop-up elements are a foreground pop-up element, a background pop-up element, and a third pop-up element.

22. The pop-up device in accordance with claim 21, wherein said third pop-up element is in the form of a detachable coupon.

* * * * *